US007420553B2

(12) United States Patent
Tseng et al.

(10) Patent No.: US 7,420,553 B2
(45) Date of Patent: Sep. 2, 2008

(54) CONTROL CIRCUIT AND METHOD THEREOF FOR REDUCING POWER CONSUMPTION OF A DISPLAY DEVICE

(75) Inventors: Shih-Hua Tseng, Taipei (TW); Ray-Din Lee, Taipei (TW)

(73) Assignee: Tatung Co., Ltd., Taipei (TW)

( * ) Notice: Subject to any disclaimer, the term of this patent is extended or adjusted under 35 U.S.C. 154(b) by 669 days.

(21) Appl. No.: 11/135,359

(22) Filed: May 24, 2005

(65) Prior Publication Data

US 2006/0146043 A1 Jul. 6, 2006

(30) Foreign Application Priority Data

Dec. 30, 2004 (TW) ..... 93141396 A

(51) Int. Cl.
*G09G 5/00* (2006.01)

(52) U.S. Cl. ..... 345/213; 345/211

(58) Field of Classification Search ..... 345/210–215; 323/282–286; 363/16–21; 364/528; 713/300, 713/310; 370/373
See application file for complete search history.

(56) References Cited

U.S. PATENT DOCUMENTS 5,572,653 A * 11/1996 DeTemple et al. ..... 345/501
6,358,111 B1 * 3/2002 Fong et al. ..... 446/297
6,473,078 B1 * 10/2002 Ikonen et al. ..... 345/211
6,523,127 B1 * 2/2003 Takasu ..... 713/324
6,760,851 B2 * 7/2004 Teshima et al. ..... 713/320
7,222,250 B2 * 5/2007 Matsubara ..... 713/320
2004/0181702 A1 * 9/2004 Cheng ..... 713/320
2004/0252076 A1 * 12/2004 Kodama ..... 345/3.1
2005/0244131 A1 * 11/2005 Uehara ..... 386/46

* cited by examiner

*Primary Examiner*—Nitin Patel
(74) *Attorney, Agent, or Firm*—Bacon & Thomas, PLLC.

(57) ABSTRACT

The invention discloses a control circuit and method thereof, which enable a display device to have low power consumption. The display device is able to switch between a normal mode and a standby mode, and reduce the power consumption of the display device under the standby mode. A synchro signal detection circuit, an infrared receiver, and a power switch are used to determine when to output a triggering signal. If an MCU inputs a triggering signal, a switch circuit will provide electricity for a peripheral circuit, then the display device switches to the normal mode; otherwise, the switch circuit will stop providing electricity for the peripheral circuit, and the display device switches to the standby mode.

11 Claims, 4 Drawing Sheets

CONTROL CIRCUIT AND METHOD THEREOF FOR REDUCING POWER CONSUMPTION OF A DISPLAY DEVICE

BACKGROUND OF THE INVENTION

1. Field of the Invention

The present invention relates to a control circuit and method thereof and more particularly, to a control circuit and method thereof for reducing power consumption of a display device.

2. Description of Related Art

Most computers have a function as standby mode, which instantly switches a computer over to a suspended state. When a computer is on and running, a power supplier can only transform 60~70% of the 120 volts alternating currents (AC) into the proper AC, such as 12 volts, 5 volts, or 3.3 volts, that are needed for interior system components. Then, the rest of the 120 volts AC mostly will be lost in the form of heat energy. However, a computer or an entertainment system has to be connected most of the time; therefore, the idea of using the standby mode in order to reduce the power consumption is hard to achieve, and besides the heat energy may influence the lifespan of display panel. Furthermore, a MCU (micro control unit) of a product with a television-like function usually does not support the detection of the horizontal and vertical synchronization signal. Under the standby mode, the requirement of reducing more of the power consumption, such as below 1 watt, will cause the computer to malfunction, i.e., the device cannot be switched over from the standby mode to the normal mode.

SUMMARY OF THE INVENTION

As stated in the related art, the goal of minimizing the power consumption of a display panel under the standby mode is hard to achieve. Thus, the present invention has been accomplished under the circumstances in view of this shortcoming. The present invention discloses a control circuit and a method thereof for reducing power consumption of a display device. The control circuit comprises components as follows: a synchro signal detection circuit, an infrared receiver, a power switch, a circuit switch, and an MCU. If one of the following situations takes place, the synchro signal detection circuit, the infrared receiver, or the power switch will output a triggering signal: (A) the synchro signal detection circuit detects a synchro signal of an analog computer video signal; (B) the infrared receiver detects an infrared signal sent by a remote controller; (C) the power switch has been selected. Then, if the MCU inputs a triggering signal, which commands the circuit switch to provide electricity for a peripheral circuit, the display device will switch over to the normal mode. On the contrary, if the MCU does not input a triggering signal, the circuit switch will stop providing any electricity for a peripheral circuit, and then the display device will switch over to the standby mode.

Additionally, a peripheral circuit as set forth above can be the 1st analog-digital converter, a scaler, the 2nd analog-digital converter, a video decoder, a de-interlacer, a ghost canceller, or a 3D comb-filter.

Therefore, by using the control circuit mentioned above, the goal of minimizing the power consumption and extending the lifespan of a display panel under the standby mode can be accomplished.

Furthermore, to accomplish the goal described in the last paragraph, the present invention reveals a method of reducing power consumption of a display device. The method comprises steps as follows: (A) initializing a control circuit; (B) initializing a peripheral circuit; (C) determining whether the control circuit is switched over to the standby mode; if it is so switched, the peripheral circuit set forth above should be switched to the standby mode; (D) determining whether a triggering signal has been detected; if it has so detected, the peripheral circuit should be switched over to the normal mode.

Therefore, the present invention can achieve the goal of minimizing the power consumption and extending the lifespan of the display panel under the standby mode.

DETAILED DESCRIPTION OF THE PREFERRED EMBODIMENT

The control circuit and method thereof of the present invention can reduce the power consumption of the display device, and then increase the lifespan of the display device.

Figure 1:
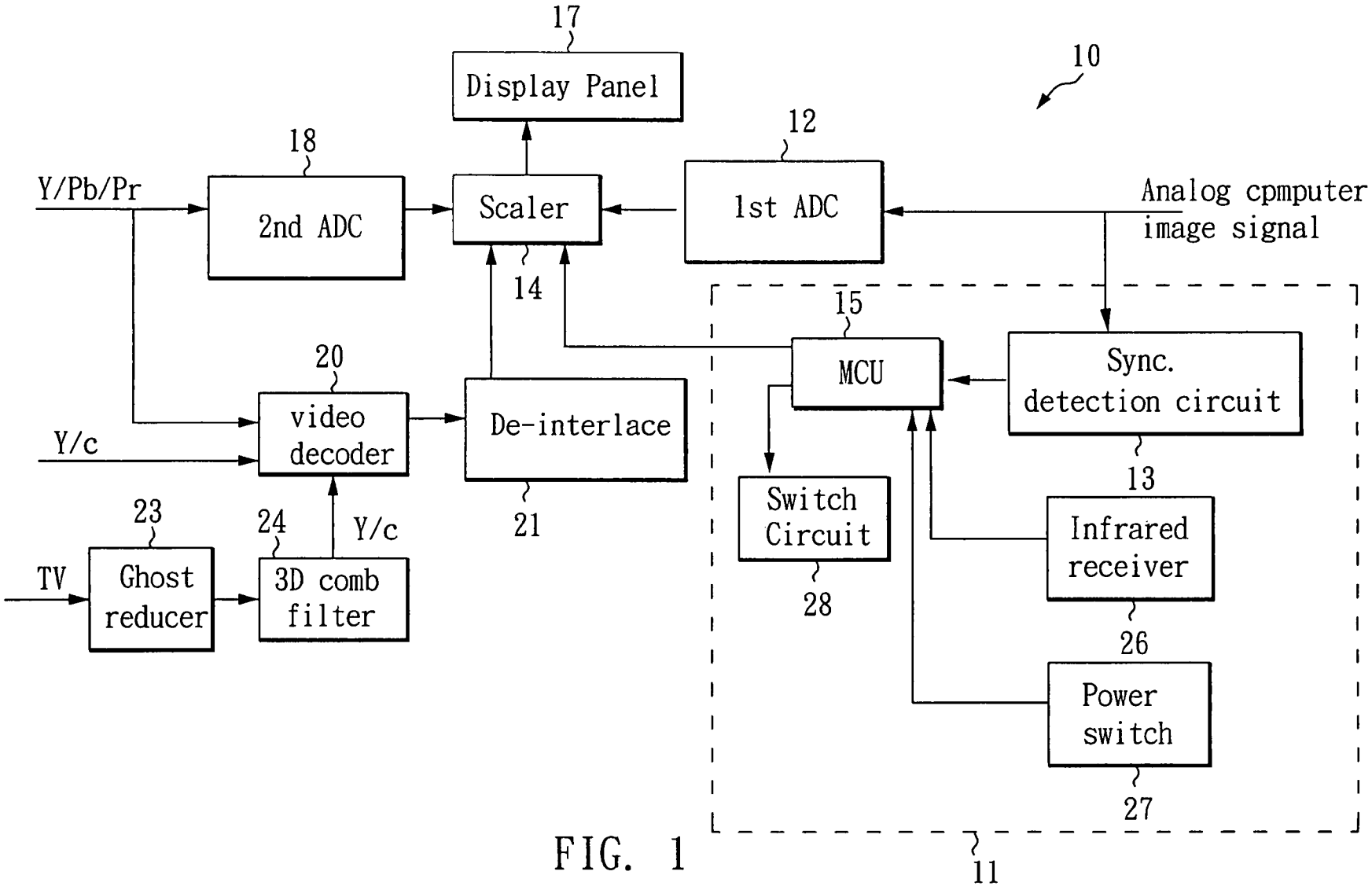
FIG. 1 is a system block diagram of the display device.

FIG. 1 shows a block diagram of a control circuit 11 of a display device 10 of the present invention, wherein the display device 10 is an LCD display device. As shown in FIG. 1, the display device 10 inputs an analog computer video signal to a synchro signal detection circuit 13 and the 1st analog-digital converter 12. When the synchro signal detection circuit 13 detects the synchro signal, it will send a triggering signal to the MCU 15. When the MCU 15 does not input a triggering signal, it commands the power supplier (not shown) to stop providing electricity to the other electrical components of the display device 10, which includes the 1st analog-digital converter 12, a scaler 14, a display panel 17, the 2nd analog-digital converter 18, a video decoder 20, a de-interlace 21, a ghost reducer 23, and a 3D comb-filter 24. Because the power supplier only has to provide electricity to run the control circuit 11 of the present invention, it can effectively reduce the electrical consumption of the display device 10.

Figure 2:
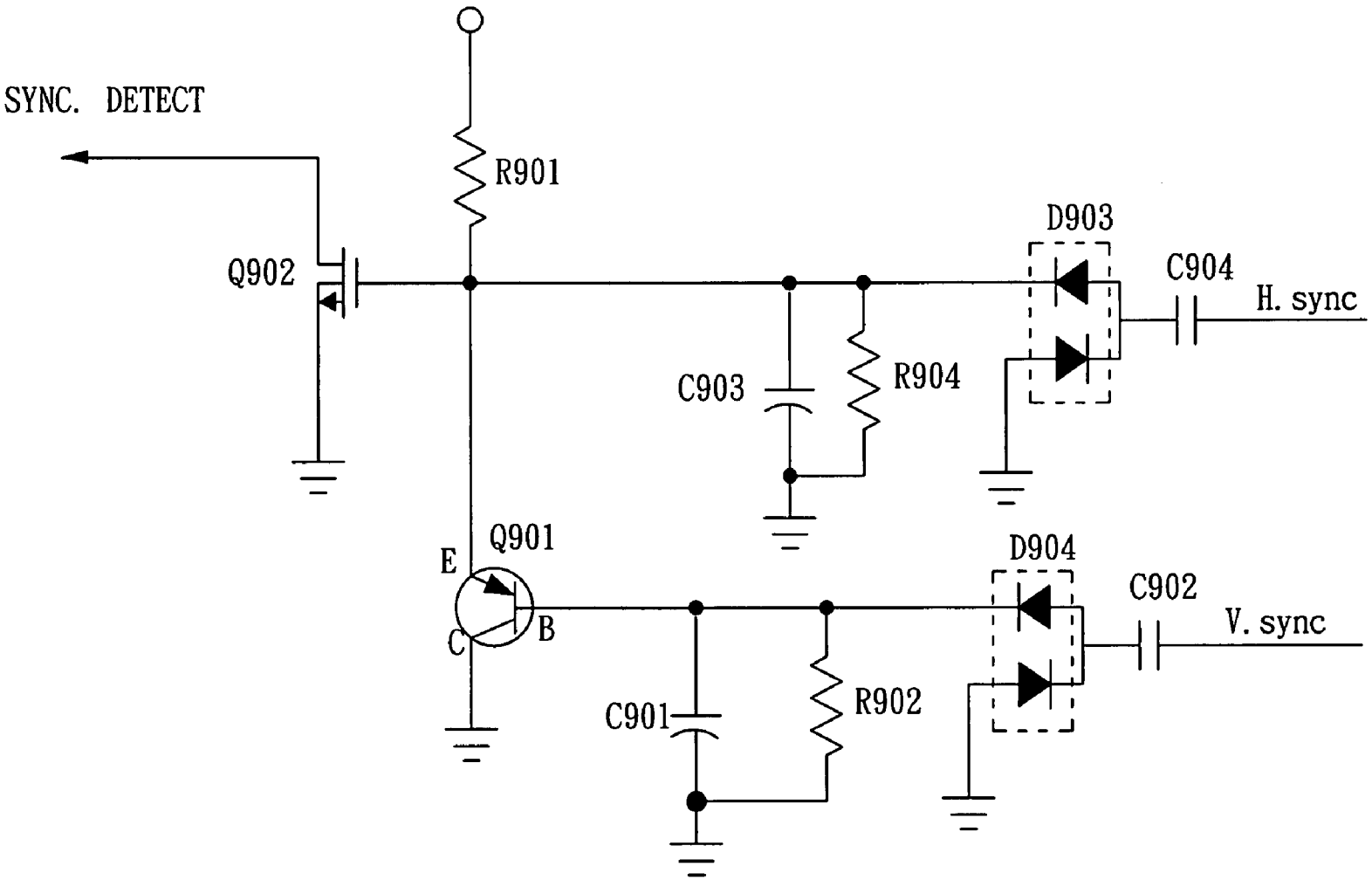
FIG. 2 is a circuit diagram of the synchro signal detection circuit.

As shown in FIG. 1, the control circuit 11 of the present invention comprises the following components: the synchro signal detection circuit 13, the MCU 15, an infrared receiver 26, a power switch 27, and a switch circuit 28. An analog computer image signal includes horizontal synchro signals (labeled as H. Sync) and vertical synchro signals (labeled as V. Sync), thus the synchro signal detection circuit 13 can detect the presences of any synchro signal (including horizontal and vertical synchro signals). If a synchro signal is present, the circuit will output a triggering signal to the MCU 15. Please refer to FIG. 2 for how the synchro signal detection circuit 13 detects the presences of the synchro signal. The steps for detecting synchro signals are as follows: (i) if a horizontal synchro signal is present, after the signal goes through a capacitance C904, a clamp circuit D903, and a wave-filter process of a resistance R904 and a capacitance C903, the capacitance C903 can supply high electric potential; (ii) if a vertical synchro signal is present, after the signal goes through a capacitance C902, a clamp circuit D904, and a wave-filter process of a resistance R902 and a capacitance C901, the capacitance C901 can supply high electric potential. As a result, the transistor Q901 will not be turned on, and then the capacitance C903 can still supply high electric potential; (iii) Because the capacitance C903 can supply high electric potential, which turns on transistor Q902, the MCU 15 is able to detect logic "0", and such logic "0" represents a triggering signal. On the contrary, (i) if a horizontal synchro signal is not present, no signal goes through the capacitance C904, the clamp circuit D903, nor the wave-filter process of the resistance R904 and the capacitance C903, so the capacitance C903 can supply low electric potential; (ii) if a vertical synchro signal is not present, no signal goes through the capacitance C902, the clamp circuit D904, nor the wave-filter process of the resistance R902 and the capacitance C901, so the capacitance C901 can supply low electric potential. As a result, the transistor Q901 will be turned on, and then a capacitance C903 can still supply low electric potential; iii) Because the capacitance C903 supplies low electric potential, the transistor Q902 will not be turned on, so the MCU 15 is able to detect logic "1", and such logic "1" represents the non-triggering signal.

Furthermore, the infrared receiver 26 and the power switch 27 are capable of sending triggering signals to the MCU 15, too. The infrared receiver 26 can receive infrared signals sent by another remote controller (not shown). When the user presses the button of a remote controller, the remote controller will send a corresponding infrared signal to the infrared receiver 26. Then, the infrared receiver 26 will send a triggering signal to the MCU 15. On the other hand, the operator also can output a relative infrared signal to the infrared receiver 26, which stops the infrared receiver 26 from sending out a triggering signal to the MCU 15. Additionally, a power switch 27 can be stalled on the display panel 17. By turning on the power switch 27, the operator can use the power switch 27 to output a triggering signal to the MCU 15, and vice versa. To summarize the above, the synchro signal detection circuit 13, the infrared receiver 26, and the power switch 27 all are able to output or stop outputting a triggering signal to the MCU 15.

Figure 3:
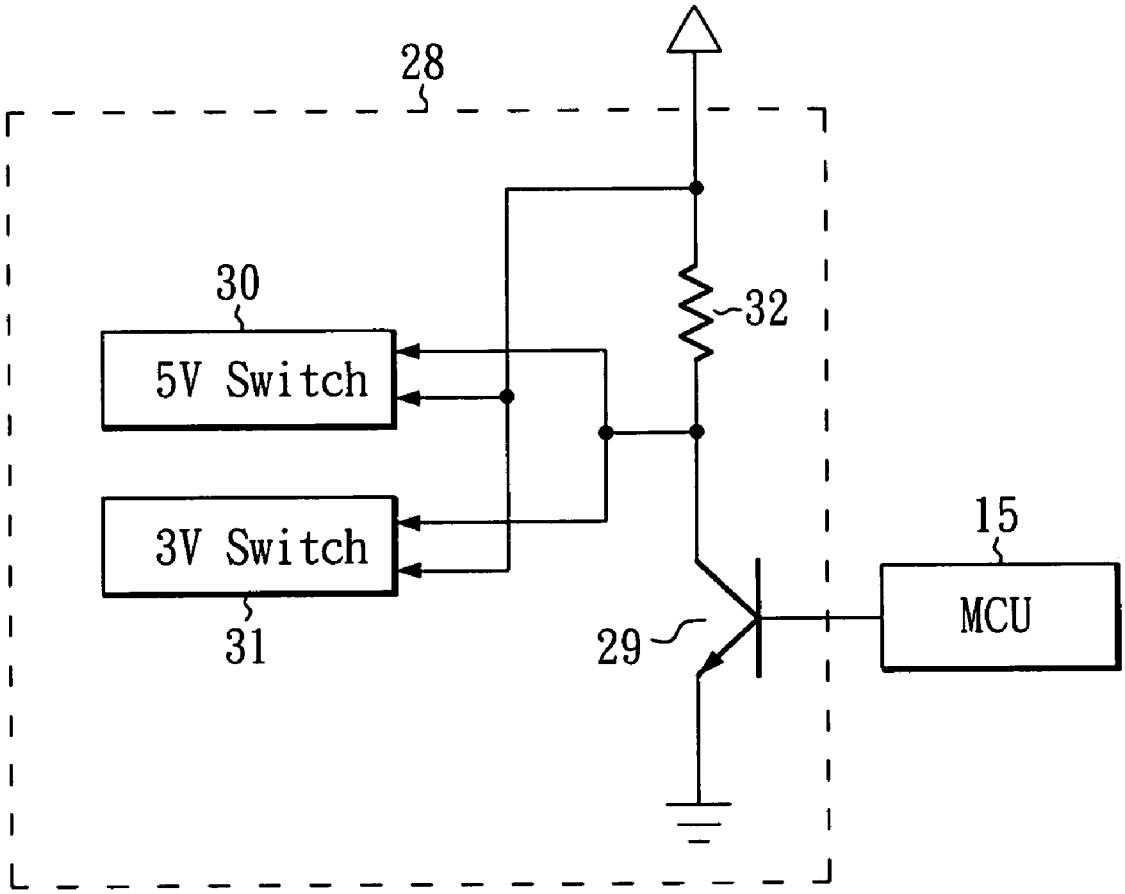
FIG. 3 is a functional diagram of the circuit switch.

As shown in FIG. 3, a switch circuit 28 comprises: a transistor 29, a 5V switch 30, a 3V switch 31, and a resistance 32. When the MCU 15 did not detect a triggering signal, the MCU 15 will not turn on the transistor 29; therefore, the output terminal of the resistance 32 remains at high electric potential. Even though the power supplier provides electricity to the 5V switch 30 and 3V switch 31, in fact the 5V switch 30 and 3V switch 31 do not output electric power to other electrical components. When the MCU 15 detects a triggering signal, the MCU 15 will turn on the transistor 29; therefore, the output terminal of resistance 32 lowers its electric potential. Then, the 5V switch 30 and 3V switch 31 will output electric power to other electrical components, which enables the other electrical components to switch from the standby mode to the normal mode. As a result, the display device 10 can function accordingly.

Figure 4:
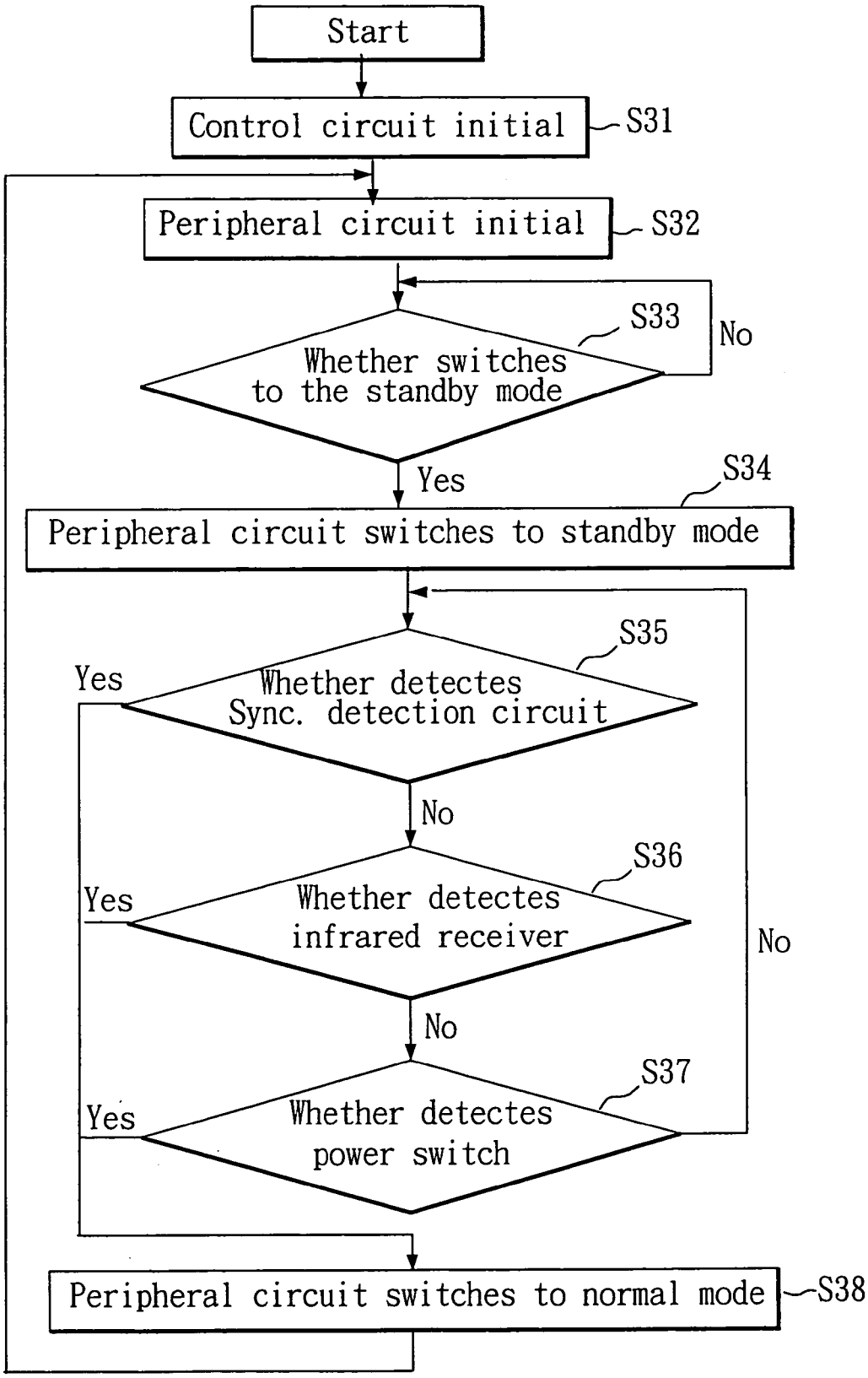
FIG. 4 is a flow chart of reducing power consumption of the display device of the present invention.

As shown in FIG. 4, the method of reducing power consumption of the display device 10 of the present invention comprises the steps as below:

Step 31: initializing the control circuit 11. The control circuit 11 comprises: the synchro signal detection circuit 13, the MCU 15, the infrared receiver 26, the power switch 27, and the switch circuit 28.

Step 32: initializing a peripheral circuit. The peripheral circuit comprises: the 1st analog-digital converter 12, the scaler 14, the display panel 17, the 2nd analog-digital converter 18, the video decoder 20, the de-interlace 21, the ghost reducer 23, and the 3D comb-filter 24.

Step 33: determining whether the display device 10 switches to the standby mode. If it does so switch, the peripheral circuit will be switched to the standby mode; if it does not, it will repeat step 33. The control circuit 11 detects whether a triggering signal exists; if it exists, the peripheral circuit will stay in the normal mode; otherwise, it will switch over to the standby mode to reduce the power consumption of the display device 10. At this point, the power supplier only has to provide power to the control circuit 11; therefore, the power consumption of the display device 10 can be reduced.

Step 35: determining whether a triggering signal of the synchro signal detection circuit 13 is detected; if a signal is detected, the peripheral circuit will be switched to the normal mode (step 38) and then go to step 32; otherwise, go to step 36.

Step 36: determining whether a triggering signal of the infrared receiver 26 is detected. Such triggering signal includes signals from the power switch, the channel switch etc. If a signal is detected, the peripheral circuit will be switched to the normal mode (step 38) and then go to step 32; otherwise, go to step 37.

Step 37: determining whether a triggering signal of the power switch 27 is detected. If a signal is detected, the peripheral circuit will be switched to the normal mode (step 38) and go to step 32; otherwise, go to step 35.

Under the standby mode, the peripheral circuit does not consume any power; therefore, the control circuit and a method thereof of the present invention can certainly accomplish the goal of reducing power consumption of a display device, and also satisfy the demand of the consumers for a low-power-consumption device.

Although the present invention has been explained in relation to its preferred embodiment, it is to be understood that many other possible modifications and variations can be made without departing from the spirit and scope of the invention as hereinafter claimed.

What is claimed is:

1. A control circuit capable of enabling a display device to switch between a normal mode and a standby mode and reducing power consumption of said display device when in the standby mode, comprising:

a synchro signal detection circuit, wherein when said synchro signal detection circuit detects a synchro signal of an analog computer image signals, said circuit will output a triggering signal;

an infrared receiver, wherein when said infrared receiver detects an infrared signal sent by a remote controller, said infrared receiver will output a triggering signal;

a power switch, wherein when said power switch is actuated, said power switch will output a triggering signal;

a switch circuit which provides enough power for a peripheral circuit; and an MCU, wherein when said MCU inputs a triggering signal, said switch circuit will provide enough power for a peripheral circuit to run; said display device switches to normal mode; when said MCU does not input a triggering signal, said switch circuit will stop providing power to said peripheral circuit; then said display device switches to standby mode.

2. The control circuit as claimed in claim 1, wherein said synchro signals comprise horizontal synchro signals and vertical synchro signals.

3. The control circuit as claimed in claim 1, wherein said display device is an LCD television, plasma panel etc.

4. The control circuit as claimed in claim 1, wherein said peripheral circuit comprises: a 1st analog-digital converter, a scaler, a 2nd analog-digital converter, a video decoder, a de-interlacer, a ghost reducer, and a 3D comb-filter.

5. A method of reducing power consumption of a display device, which enables a display device to switch between a normal mode and a standby mode and reduces power consumption of said display device when in the standby mode, the method comprising the steps of:

(A) initializing a control circuit;

(B) initializing a peripheral circuit;

(C) determining whether said display device switches to the standby mode; if it is in the standby mode, said peripheral circuit will be switched to the standby mode; and (D) determining whether a triggering signal is detected; if said triggering signal is detected, said peripheral circuit will be switched to the normal mode;

wherein when said peripheral circuit is in the standby mode, power for said peripheral circuit ceases.

6. The control circuit as claimed in claim 5, wherein said display device is an LCD television or a plasma panel.

7. The control circuit as claimed in claim 5, wherein said triggering signal corresponds to a synchro signal of analog computer image signals.

8. The control circuit as claimed in claim 5, wherein said triggering signal corresponds to an infrared signal of a remote controller.

9. The control circuit as claimed in claim 5, wherein said triggering signal is sent by a power switch.

10. The control circuit as claimed in claim 5, wherein said control circuit comprises: a synchro signal detection circuit, an infrared receiver, a power switch, a switch circuit, and an MCU.

11. The control circuit as claimed in claim 5, wherein said peripheral circuit comprises: a 1st analog-digital converter, a scaler, a 2nd analog-digital converter, a video decoder, a de-interlacer, a ghost reducer, and a 3D comb-filter.

* * * * *